US009220351B2

(12) United States Patent
Jensen et al.

(10) Patent No.: US 9,220,351 B2
(45) Date of Patent: Dec. 29, 2015

(54) MATTRESS COVER ASSEMBLY AND METHOD

(71) Applicants: Ida Tulsgaard Jensen, Kobenhavn N (DK); Rikke Lund Jorgensen, Odense NV (DK); Charlotte Dybdahl, Middelfart (DK); Jeanet K. Holkenberg, Middelfart (DK); Tina Bang Nielsen, Randbol (DK); Dorthe Bang Iversen, Glamsbjerg (DK); Kristina Skjoldemose Asklof, Nyborg (DK); Annette H. Frausig, Middelfart (DK)

(72) Inventors: Ida Tulsgaard Jensen, Kobenhavn N (DK); Rikke Lund Jorgensen, Odense NV (DK); Charlotte Dybdahl, Middelfart (DK); Jeanet K. Holkenberg, Middelfart (DK); Tina Bang Nielsen, Randbol (DK); Dorthe Bang Iversen, Glamsbjerg (DK); Kristina Skjoldemose Asklof, Nyborg (DK); Annette H. Frausig, Middelfart (DK)

(73) Assignee: Dan-Foam ApS, Aarup (DK)

( * ) Notice: Subject to any disclaimer, the term of this patent is extended or adjusted under 35 U.S.C. 154(b) by 0 days.

(21) Appl. No.: 14/669,431

(22) Filed: Mar. 26, 2015

(65) Prior Publication Data

US 2015/0196147 A1 Jul. 16, 2015

Related U.S. Application Data

(63) Continuation-in-part of application No. PCT/IB2012/055127, filed on Sep. 26, 2012.

(51) Int. Cl.

| | |
|---|---|
| ***A47C 21/02*** | (2006.01) |
| ***A47C 27/00*** | (2006.01) |
| ***A47C 31/10*** | (2006.01) |

(52) U.S. Cl.

CPC ..... *A47C 21/026* (2013.01); *A47C 27/002* (2013.01); *A47C 31/105* (2013.01)

(58) Field of Classification Search

CPC ... A47C 27/002; A47C 31/105; A47C 21/026
USPC ..... 5/499, 500, 411, 738, 485
See application file for complete search history.

(56) References Cited

U.S. PATENT DOCUMENTS

| | | | | |
|---|---|---|---|---|
| 1,959,920 | A * | 5/1934 | Kaiser | 5/498 |
| 4,517,693 | A * | 5/1985 | Viesturs | 5/681 |
| 6,601,250 | B1 * | 8/2003 | Taylor | 5/485 |
| 8,701,227 | B2 * | 4/2014 | Rohr | 5/411 |
| 2010/0325800 | A1 * | 12/2010 | Huang | 5/618 |
| 2011/0138533 | A1 * | 6/2011 | Rippe et al. | 5/499 |

FOREIGN PATENT DOCUMENTS

| | | | | |
|---|---|---|---|---|
| CA | 2885939 | A1 * | 3/2014 | A47C 31/10 |
| WO | WO 2014/049394 | A1 * | 3/2014 | A47C 31/10 |

* cited by examiner

*Primary Examiner* — Michael Trettel
(74) *Attorney, Agent, or Firm* — J. Mark Wilkinson, Esq.

(57) ABSTRACT

A mattress cover assembly, for use with a mattress supported upon an adjustable foundation having at least one movable frame portion, includes a cover in which the mattress is at least partially positionable. The cover has a head portion coinciding with a head of the mattress and a foot portion coinciding with a foot of the mattress. The mattress cover assembly also includes a pocket located at one of the head portion and the foot portion of the cover. A first movable frame portion of the adjustable foundation is at least partially receivable in the pocket for securing the one of the head portion and die foot portion of the cover to the first movable frame portion.

22 Claims, 4 Drawing Sheets

MATTRESS COVER ASSEMBLY AND METHOD

RELATED APPLICATION

This application is a continuation-in-part of International Patent Application No PCT/IB2012/055127, the entire disclosure of which is incorporated herein by this reference.

FIELD OF THE INVENTION

The present invention relates to mattress covers, and more particularly to mattress covers the use with adjustable mattress foundations.

BACKGROUND OF THE INVENTION

Mattress covers are typically utilized to enclose mattresses supported upon mattress foundations. Some foundations are adjustable to vary the shape of the mattress supported thereon in accordance with a user's comfort level. Such foundations are typically operable to incline a portion of the mattress associated with the user's head and shoulders, and/or another portion of the mattress associated with the user's legs and feet. With varying degrees of success, mattresses can be retained in place upon adjustable mattress foundations (e.g., as the foundations are manipulated between inclined and flat configurations) using appropriately-positioned brackets, headboard and footboard sets, bumpers, and the like. However, conventional devices to perform this function often inadequately retain various mattress types in place upon the foundation, require significant structure and hardware, are lacking in aesthetics, and have a number of other shortcomings.

SUMMARY OF THE INVENTION

The present invention provides, in one aspect, a mattress cover assembly for use with a mattress supported upon an adjustable foundation having at least one movable frame portion. The mattress cover assembly includes a cover in which the mattress is at least partially positionable. The cover has a bead portion coinciding with a head of the Mattress and a foot portion coinciding with as foot of the mattress. The mattress cover assembly also includes a pocket located at one of the head portion and the foot portion of the cover. The movable frame portion is at least partially receivable in the pocket for securing the one of the head portion and the foot portion of the cover to the movable frame portion. One or more straps are further included in the mattress cover assembly, with each strap extending around at least one movable frame portion to secure the cover to the adjustable foundation.

The present invention provides, in another aspect, a method of assembling a mattress onto an adjustable foundation having at least one movable frame portion. The method includes providing a cover having a head portion coinciding with a head of the mattress, a foot portion coinciding with a foot of the mattress, and at least partially enclosing the mattress in the cover. The method, further includes inserting the movable frame portion into a first pocket located at one of the head portion and the toot portion of the cover for securing the one of the head portion and the foot portion of the cover to the movable frame portion. Each of the one or more straps can then be extended around the movable frame portion to further secure the cover to the adjustable foundation.

Other features and aspects of the invention become apparent consideration of the following detailed description and accompanying drawings.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
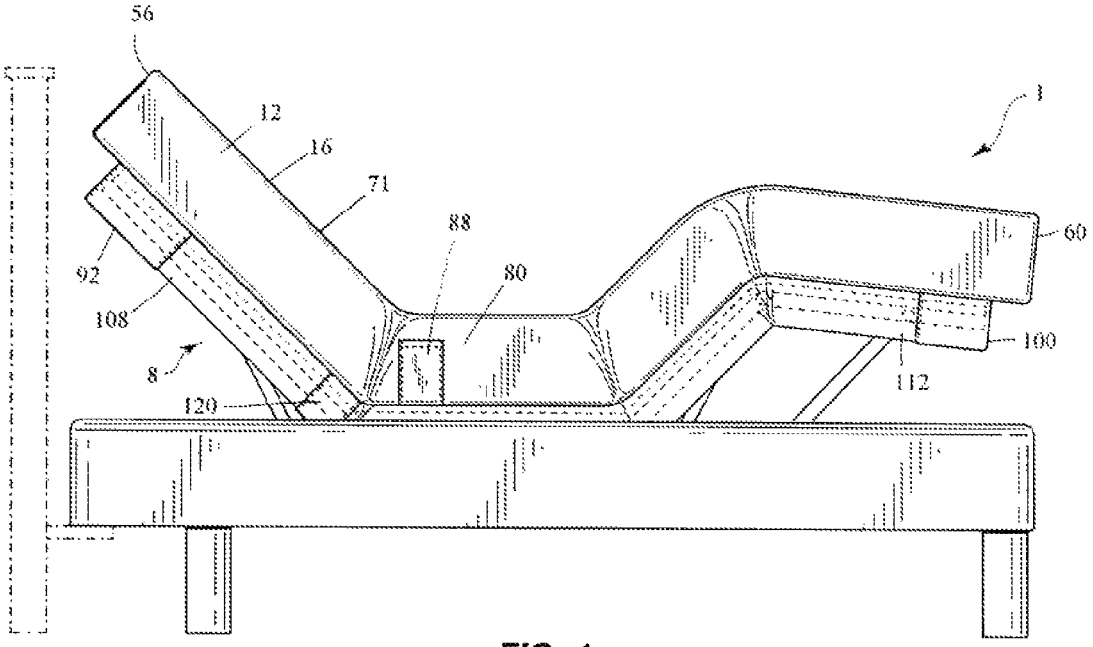
FIG. 1 is a side view oft a mattress cover assembly of the invention, enclosing a mattress supported upon an adjustable mattress foundation in an inclined or raised configuration.
Figure 2:
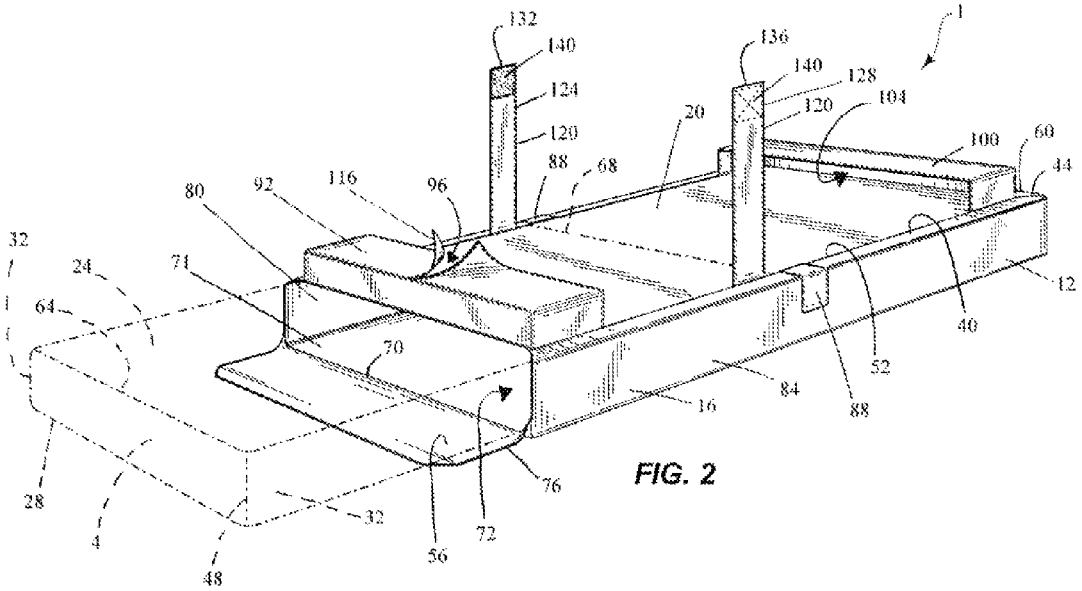
FIG. 2 is a bottom perspective view of the mattress coyer assembly of FIG. 1, in which the mattress is partially inserted therein.

FIGS. 1 and 2 illustrate a mattress cover assembly 1 for use with a mattress 4 supported upon an adjustable mattress foundation 8 (FIG. 1). The mattress cover assembly 1 includes a cover 12 in which the mattress 4 is positioned or enclosed. In the illustrated construction of the assembly 1, the cover 12 includes both a main panel 16 and a bottom panel 20 (FIG. 2), which is positioned between a bottom surface 24 of the mattress 4 and the top of the adjustable mattress foundation 8. In the illustrated construction of the mattress cover assembly 1, the main panel 16 covers both the top 28 and the sides 32 of the mattress 4, in addition to wrapping around the bottom 24 of the mattress 4. Particularly, the main panel 16 has inboard portions 40 positioned proximate the bottom panel 20 of the cover 12. The inboard portions 40 have stitching 44 coinciding with four corners 48 of the mattress 4, and are attached to the bottom panel 20 by additional stitching 52. As a result, the mattress 4 may be entirely enclosed within the cover 12. Alternatively, the bottom panel 20 of the cover 12 may be omitted such that the bottom 24 of the mattress 4 may be in direct contact with the adjustable mattress foundation 8. In such an alternative, the mattress 4 is only partially enclosed within the covet 12. As a further alternative, the bottom panel 20 may be detachable from the main panel 16 via a zipper, hook and loop fastener material, snaps, etc. In still other alternative constructions of the cover 12, the main panel 16 may be divided into two or more sub-panels attached to each other by stitching, only or more zippers, hook and loop fastener material, snaps, etc.

Figure 3:
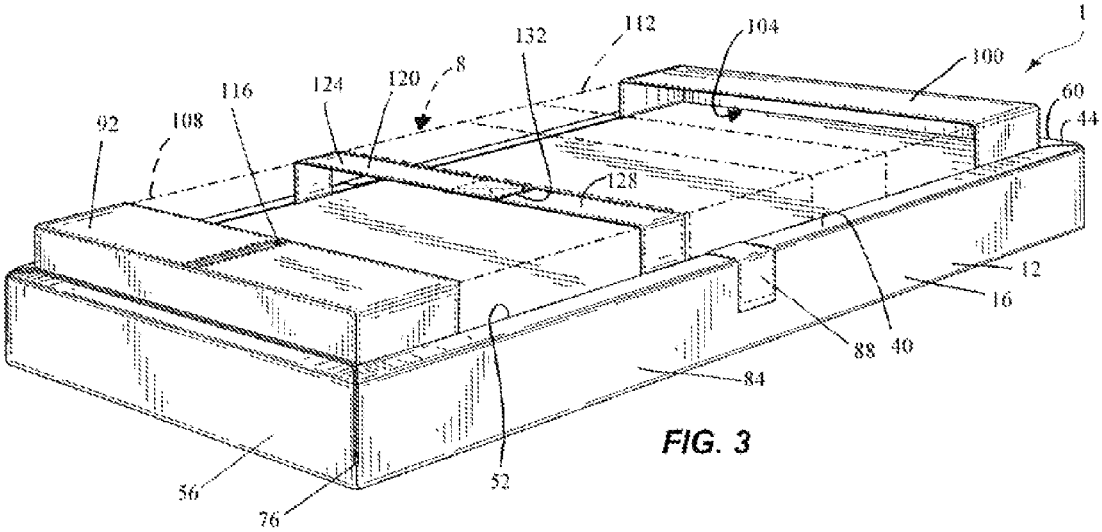
FIG. 3 is a bottom perspective view of the mattress cover assembly of FIG. 1, enclosing the mattress and illustrating the mattress cover assembly secured to movable portions of the adjustable mattress foundation.

With continued reference to FIG. 2, the cover 12 also includes head and foot portions 56, 60 coinciding with a head 64 and a foot 68 of the mattress 4, respectively. The head portion 56 is configured as a flap that is foldable along a crease 70 relative to a top portion 71 of the main panel 16 of the cover 12. As such, the head portion 56 is movable between a flat or unfolded orientation, which is substantially co-planar with the top portion 71 of the main panel 16 (FIG. 2), and a folded orientation, which is substantially transverse to the top portion 71 of the main panel 16 (FIG. 3). The cover 12 further has an opening 72 located proximate the head portion 56 of the cover 12 through which the mattress 4 is movable. The opening 72 is reconfigurable between an open configuration (coinciding with the unfolded orientation of the head portion 56; FIG. 2) for inserting or removing the mattress 4 from the cover 12 and a dosed configuration (coinciding with the folded orientation of the head portion 56; FIG. 3) for enclosing the mattress 4 within the cover 12. The cover 12 includes a closure device 76 (e.g., reversed 6 mm zipper) having a U-shape coupled to the head portion 56 of the cover 12 for selectively closing the opening 72 in the cover 12 (FIGS. 2 and 3). Alternatively, the closure device 76 may be any number of devices having any number of shapes and including, but not limited to, buttons, snaps, and hook and loop fastener material. The closure device 76 (and therefore the opening 72) may be closed when the head portion 56 of the cover 12 is in its folded orientation. The cover 12 also, includes opposed first and second sides 80, 84, each interconnecting the head and foot portions 56, 60 of the cover 12 (FIG. 2). With reference to FIGS. 1-3, each side 80, 84 has a pocket 88 attached thereto for the storage of items (e.g., a remote control for operating the adjustable foundation, etc.). Alternatively, only one side 80, 84 of the cover 12 may include a pocket 88. In yet another embodiment, the pocket 88 could be positioned elsewhere such as near the head of the mattress 4.

With reference to FIG. 2, the mattress cover assembly 1 includes a first pocket 92 attached to the head portion 56 of the cover 12 and defining an opening 96 facing the foot portion 60 of the cover 12. The illustrated mattress cover assembly 1 also includes a second pocket 100 attached to the foot portion 60 of the cover 12 and defining an opening 104 facing the head portion 56 of the cover 12. The first and second pockets 92, 100 receive corresponding movable frame portions 108, 112 of the adjustable mattress foundation 8 to secure the cover 12 and therefore the enclosed mattress 4 to the adjustable mattress foundation 8 (FIGS. 1 and 3) although in some embodiments only one of the pockets 92, 100 is provided.

With continued reference to the illustrated embodiment the adjustable mattress foundation 8 includes first and second movable frame portions 108, 112 coinciding with the head 64 and foot 68 of the mattress 4, respectively. The illustrated first and second movable frame portions 108, 112 are reconfigurable between an inclined or raised configuration for supporting the mattress 4 in an inclined or raised orientation (FIG. 1) and a flat configuration for supporting the mattress 4 thereon in a flat orientation (FIG. 3). It should also be understood that the adjustable mattress foundation 8 can be adjustable to any of a number of partially inclined or raised configurations between the raised and flat configurations, depending upon user preference and comfort.

With reference to FIGS. 1 and 3, the first and second movable frame portions 108, 112 are at least partially received in the first and second pockets 92, 100, respectively, by inserting the first and second movable frame portions 108, 112 into the respective openings 96, 104 of the first and second pockets 92, 100. As such, the first pocket 92, which is located proximate the head portion 56 of the cover 12, secures the head portion 56 of the cover 12 to the first movable frame portion 108 while the second pocket 100 secures the foot portion 60 of the cover 12 to the second movable frame portion 112. The first pocket 92 includes a closure device 116 (e.g., a reversed 6 mm zipper) for selectively opening the first pocket 92 to facilitate insertion of the first movable frame portion 108 into the first pocket 92. The closure device 116 is manipulated between an open configuration (FIG. 2), in which the first movable frame portion 108 may be loosely retained in the first pocket 92, and a closed configuration (FIG. 3), in which the first movable frame portion 108 is tightly retained in the first pocket 92. In an alternative construction, the second pocket 100 may also include a closure device (e.g., a zipper) for selectively opening the second pocket 100 to facilitate insertion of the second movable frame portion 112 into the second pocket 100. In such an alternative, the closure device may be manipulated between an open configuration, in which the second movable frame portion 112 may be loosely retained in the second pocket 100, and a closed configuration, in which the second movable frame portion 112 may be tightly retained in the second pocket 100.

With reference to FIGS. 2 and 3, the mattress cover assembly 1 further includes a strap 120 that extends around the first movable frame portion 108 of the adjustable mattress foundation 8 to secure the cover 12 to the first movable frame portion 108. The strap 120 includes two layers of textile material sewn together, and is coupled to the cover 12 at a location between the head and foot portions 56, 60 of the cover 12. The strap 120 includes first and second segments 124, 128 attached to the cover 12 at locations proximate the sides 80, 84 of the cover 12, respectively that coincide with the stitching 52. The first and second segments 124, 128 have respective distal ends 132, 136 and are selectively interconnected by a closure device 140 (e.g., a hook and loop fastener FIG. 2). As such the respective distal ends 132, 136 of the segments 124, 128 overlap each other when the segments 124, 128 are interconnected by the closure device 140. Alternatively, the first and second segments 124, 12 may be interconnected by another closure device (e.g., a zipper, latches, buckles, etc.).

As a refinement to the present invention, an exemplary mattress cover assembly need not be limited to a single strap that extends around the first movable frame portion, but can instead include multiple straps positioned at various locations along the movable frame portions of an adjustable mattress foundation. For example, with reference to FIG. 4, another mattress cover assembly 201 of the present invention is illustrated that, like the mattress cover assembly 1 shown in FIGS. 1-3, includes a cover 212 in which mattress 204 is positioned or enclosed. The mattress cover assembly 201 further includes a main panel 216 and a bottom panel 218, as well as first and second sides 280, 284 and head and foot portions 256, 260 with the head portion 256 configured as a flap that is foldable along a crease 270 to cover an opening 272 for placing the mattress 204 within the cover 212. Also included in the mattress cover assembly 201 is a first pocket 292 at the head portion 256 of the cover 212 and a second pocket 298 at the foot portion 260 of the cover 212 for receiving corresponding movable frame portions of an adjustable mattress assembly and securing the cover 212 and the mattress to an adjustable mattress foundation. Unlike the mattress cover assembly 1 shown in FIGS. 1-3, however, the mattress cover assembly 201 does not make use of a single strap to secure the cover 212 to a movable frame portion of an adjustable mattress foundation. Rather, the mattress cover assembly 201, includes two straps 220*a*, 220*b* to secure the cover 212 to an adjustable mattress foundation.

Figure 4:
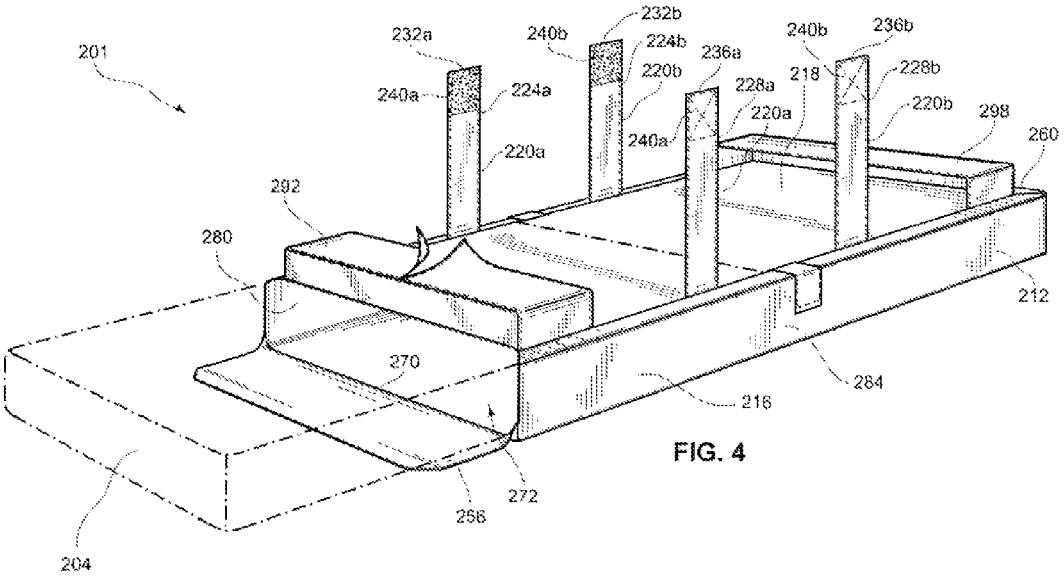
FIG. 4 is a bottom perspective view of another mattress cover assembly of the invention, in which the mattress is partially inserted therein.

Specifically, and similar to the strap 120 described above with reference to FIGS. 2 and 3, each of the two or more straps 220*a*, 220*b* of the mattress cover assembly 201 shown in FIG. 4 includes two layers of textile material sewn together, and is coupled to the cover 212 at a location between the head and foot portions 256, 260 of the cover 212. Each of the two straps 220*a*, 220*b* also includes a first segment 224*a*, 224*b* and a second segment 228*a*, 228*b* attached to the cover 212 at locations proximate to the first side 280 and the second side 284 of the cover 212. The first and second segments 224*a*, 224*b*, 228*a*, 228*b* of each of the two straps 220*a*, 220*b* have respective distal ends 232*a*, 232*b*, 236*a*, 236*b* and are selectively interconnected by a closure device 240*a*, 240*b* (e.g., a hook and loop fastener, zipper, latches, buckles, etc.) that interconnects the distal ends 232*a*, 232*b*, 236*a*, 236*b* when the two straps 220*a*, 220*b* are extended around an adjustable mattress foundation similar to what is shown and described above with reference to FIGS. 1-3. However, by including two straps 220*a*, 220*b* in the mattress cover assembly 201, the mattress cover assembly 201 is configured to be attached to moveable frame portions at opposite ends of an adjustable mattress foundation. Of course, it is also contemplated that more or less straps can be included in an exemplary mattress cover assembly and can be positioned at various other locations on an exemplary mattress cover assembly without departing from the spirit and scope of the present invention.

Regardless of the total number, or position of the straps of in an exemplary mattress cover assembly 1, and referring again to FIGS. 1-3, in assembling the mattress cover assembly 1, the mattress 4, and the adjustable mattress foundation 8, the mattress 4 is first inserted through the opening 72 in the cover 12 (FIG. 2) until the mattress 4 is fully received within the cover 12. The opening 72 is then closed by using the zipper 76 to fully enclose the mattress 4 within the cover 12 (FIG. 3). In other words, the head portion 56 of the cover 12 is in its folded orientation when the mattress 4 is fully enclosed or positioned within the cover 12. The second movable frame portion 112 is then inserted into the second pocket 100 to secure the foot portion 60 of the cover 12 to the second movable frame portion 112. The second pocket 100 provides a tight fit with the second movable frame portion 112, such that when the second movable frame portion 112 is raised or inclined by a user (FIG. 1), the second pocket 100 substantially prevents the foot 68 of the mattress 4 from sliding or moving relative to the second movable frame portion 112. Accordingly, the foot 68 of the mattress 4 is closely retained to the second movable frame portion 112 as it transitions between an inclined or raised orientation and a lowered or flat orientation.

With reference to FIG. 2, with the zipper 116 opened to thereby expand the opening 96 of the first pocket 92, the first movable frame portion 108 is then inserted into the first pocket 92. At this time, the first movable frame portion 108 is loosely retained in the first pocket 92. Thereafter, the zipper 116 is closed to reduce the size of the opening 96 of the first pocket 92, thereby tightly securing the first movable frame portion 108 to the head portion 56 of the cover 12. Like the second pocket 100, the first pocket 92 provides a tight fit with the first movable frame portion 108, such that when the first movable frame portion 108 is raised or inclined by the user, the first pocket 92 substantially prevents the head 64 of the mattress 4 from sliding or moving relative to the first movable frame portion 108. Accordingly, the head 64 of the mattress 4 is closely retained to the first movable frame portion 108 as it transitions between an inclined or raised orientation and a lowered or flat orientation.

Lastly, the segments 124, 128 of the strap 120 are extended or wrapped around the first movable frame portion 108 and interconnected via the hook and loop fasteners 140 to further secure the cover 12 to the first movable frame portion 108 (FIGS. 1 and 3). The strap 120 prevents the mattress 4 from sliding when either or both of the first and second movable frame portions 108, 112 are transitioned between an inclined or raised orientation and a lowered or flat orientation. Of course, in a mattress cover assembly including additional straps, such additional straps can be extended or wrapped around respective portions of an adjustable mattress foundation to further secure a mattress cover assembly to an adjustable mattress foundation (see, e.g., the mattress cover assembly 201 shown in FIG. 4).

Therefore, the pockets 92, 100 (or pockets 292, 298) and the strap 120 (or straps 220*a*, 220*b*) work in conjunction to substantially inhibit sliding or movement of the mattress 4 relative to the adjustable mattress foundation 8 as the foundation 8 transitions between an inclined or raised orientation and a lowered or flat orientation. In contrast, a conventional adjustable foundation is glued to the mattress and/or requires devices such as a headboard and/or bumpers to keep the mattress in place or aligned with the adjustable mattress foundation. As such, the mattress cover assembly 1 of the invention renders headboards, bumpers, and gluing of mattresses to adjustable mattress foundations unnecessary.

Various features of the invention are set forth in the following claims.

What is claimed is:

1. A mattress cover assembly for use with a mattress supported upon an adjustable foundation, the adjustable foundation including at least one movable frame portion, the mattress cover assembly comprising:

a cover in which the mattress is at least partially positionable, the cover including a head portion coinciding with a head of the mattress and a foot portion coinciding with a foot of the mattress; and a pocket located at one of the head portion and the foot portion of the cover, the movable frame portion being at least partially receivable in the pocket for securing the one of the head portion and the foot portion of the cover to the movable frame portion;

wherein the movable frame portion is a first movable frame portion, and the pocket is a first pocket located at the head portion of the cover, the mattress cover assembly further comprising a second pocket located at the foot portion of the cover, wherein a second movable frame portion of the adjustable foundation is at least partially receivable in the second pocket for securing the foot portion of the cover to the second movable frame portion; and a closure device coupled to one of the first and second pockets for selectively opening the one of the first and second pockets to facilitate insertion of the corresponding one of the first and second movable frame portions.

2. The mattress cover assembly of claim 1, wherein the first pocket defines an opening facing the knot portion of the cover, and wherein the first movable frame portion is insertable into the opening.

3. The mattress cover assembly of claim 2, wherein the opening defined by the first pocket is a first opening, wherein the second pocket defines a second opening facing the head portion of the cover, and wherein the second movable frame portion is insertable into the second opening.

4. The mattress cover assembly of claim 1, wherein the second pocket defines an opening facing the head portion of the cover, and wherein the second movable frame portion is insertable into the opening.

5. The mattress cover assembly of claim 1, wherein the closure device is manipulatable between an open configuration in which the one of the first and second movable frame portions is loosely retained in the one of the first and second pockets, and a closed configuration in which the one of the first and second movable frame portions is tightly retained in the one of the first and second pockets.

6. The mattress cover assembly of claim 1, wherein the closure device is coupled to the first pocket.

7. The mattress cover assembly of claim 1, wherein the closure device is a zipper.

8. The mattress cover assembly of claim 1, further comprising a strap coupled to the cover at a location between the head portion and the foot portion, wherein the strap is extendable around the movable frame portion to secure the cover to the movable frame portion.

9. The mattress cover assembly of claim 8, wherein the cover includes opposed first and second sides each interconnecting the head portion and the foot portion of the cover, and wherein the strap includes a first segment attached to the cover at a location proximate the first side, and a second segment attached to the cover at a location proximate the second side.

10. The mattress cover assembly of claim 8, wherein the strap comprises a first strap positioned proximate to the head portion and a second strap positioned proximate to the foot portion.

11. The mattress cover assembly of claim 1, further comprising a third pocket attached to the cover for storage of items therein.

12. A mattress cover assembly for use with a mattress supported upon an adjustable foundation, the adjustable foundation including at least one movable frame portion, the mattress cover assembly comprising:

a cover in which the mattress is at least partially positionable, the cover including a head portion coinciding with a head of the mattress and a foot portion coinciding with a foot of the mattress;

a pocket located at one of the head portion and the foot portion of the cover, the movable frame portion being at least partially receivable in the pocket for securing the one of the head portion and the foot portion of the cover to the movable frame portion;

a strap coupled to the cover at a location between the head portion and the foot portion, wherein the strap is extendable around the movable frame portion to secure the cover to the movable frame portion; and wherein the strap further includes a closure device interconnecting the first and second segments, and wherein the first and second segments include respective distal ends that overlap each other when the first and second segments are interconnected by the closure device.

13. The mattress cover assembly of claim 8, wherein the closure device includes hook and loop fastener material.

14. A mattress cover assembly for use with a mattress supported upon an adjustable foundation, the adjustable foundation including at least one movable frame portion, the mattress cover assembly comprising:

a cover in which the mattress is at least partially positionable, the cover including a head portion coinciding with a heal of the mattress and a foot portion coinciding with a foot of the mattress;

a pocket located at one of the head portion and the foot portion of the cover, the movable frame portion being at least partially receivable in the pocket for securing the one of the head portion and the foot portion of the cover to the movable frame portion; and wherein the cover includes an opening proximate one of the head portion and the foot portion of the cover through which the mattress is insertable.

15. The mattress cover assembly of claim 14, wherein the cover includes a closure device coupled to the one of the head portion and the foot portion of the cover for closing the opening.

16. The mattress cover assembly of claim 14, wherein the opening is proximate the head portion, of the cover.

17. The mattress cover assembly of claim 11, wherein the cover includes opposed first and second sides each interconnecting the head portion and the foot portion of the cover, and wherein the third pocket is attached to one of the first and second sides.

18. A method of assembling a mattress onto an adjustable foundation, the adjustable foundation including at least one movable frame portion, the method comprising:

providing a cover including a head portion coinciding with a head of the mattress and a foot portion coinciding with a foot of the mattress;

at least partially enclosing the mattress in the cover;

inserting a movable frame portion into a pocket located at one of the head portion and the foot portion of the cover for securing the one of the head portion and the foot portion of the cover to the movable frame portion;

wherein the pocket is a first pocket and the movable frame portion is a first movable frame portion, and wherein the first pocket is located at the head portion of the cover, the method further comprising inserting a second movable frame portion into a second pocket located at the foot portion of the cover for securing the foot portion of the cover to the second movable frame portion;

providing a closure device on the first pocket; and opening the first pocket with the closure device prior to insertion of the first movable frame portion into the first pocket.

19. The method of claim 18, further comprising closing the first pocket with the closure device subsequent to insertion of the first movable frame portion into the first pocket to secure the head portion of the cover to the first movable frame portion.

20. The method of claim 18, wherein insertion of the second movable frame portion into the second pocket occurs prior to insertion of the first movable frame portion into the first pocket.

21. The method of claim 18, further comprising:

providing a strap coupled to the cover at a location between the head portion and the foot portion; and extending the strap around the movable frame portion to secure the cover to the movable, frame portion.

22. A method of assembling as mattress into an adjustable foundation, the adjustable foundation including at least one movable frame portion, the method comprising:

providing a cover including a head portion coinciding with a head of the mattress and a foot portion coinciding with a foot of the mattress;

at least partially enclosing the mattress in the cover;

inserting a movable frame portion into a pocket located at one of the head portion and the foot portion of the cover for securing the one of the head portion and the foot portion of the cover to the movable frame portion;

wherein the pocket is a first pocket and the movable frame portion is a first movable frame portion, and wherein the first pocket is located at the head portion of the cover, the method further comprising inserting a second movable frame portion into a second pocket located at the foot portion of the cover for securing the foot portion of the cover to the second movable frame portion;

providing a first strap coupled to the cover at a location proximate to the head portion;

providing a second strap coupled to the cover at a location proximate to the foot portion;

extending the first strap around the first movable frame portion to secure the cover to the first lovable frame portion; and extending the second strap around the second movable frame portion to secure the cover to the second movable frame portion.

* * * * *